US006651539B1

(12) United States Patent
Eicher et al.

(10) Patent No.: US 6,651,539 B1
(45) Date of Patent: Nov. 25, 2003

(54) PERFORATING, GROOVING OR CUTTING DEVICE FOR A MULTICOLOR SHEET-FED ROTARY PRESS

(76) Inventors: Friedrich Eicher, Ringstrasse 63, D-85123 Karlskron (DE); Detlef Füessl, Richard-Strauss-Strasse 37a, D-85057 Ingolstadt (DE)

( * ) Notice: Subject to any disclaimer, the term of this patent is extended or adjusted under 35 U.S.C. 154(b) by 0 days.

(21) Appl. No.: 09/647,621

(22) PCT Filed: Mar. 22, 1999

(86) PCT No.: PCT/EP99/01920

§ 371 (c)(1),
(2), (4) Date: Oct. 2, 2000

(87) PCT Pub. No.: WO99/51440

PCT Pub. Date: Oct. 14, 1999

(30) Foreign Application Priority Data

Apr. 3, 1998 (DE) ..... 198 14 966

(51) Int. Cl.[7] ..... B26D 7/26; B26D 1/12

(52) U.S. Cl. ..... 83/698.42; 83/659; 83/678; 83/332; 83/393; 83/397; 101/226; 101/136; 270/21.1; 493/367; 493/324

(58) Field of Search ..... 493/60, 66, 324, 493/370, 365, 355, 367, 404, 471; 492/56; 83/659, 663, 698.41, 698.42, 347, 674, 343, 332, 678, 348, 911, 675, 660, 300, 302, 303, 673, 676, 695; 101/226, 227

(56) References Cited

U.S. PATENT DOCUMENTS 1,618,191 A * 2/1927 Hemberger ..... 83/347
2,863,337 A * 12/1958 Ackley ..... 101/401.1
3,430,560 A * 3/1969 Nettleman ..... 101/407.1
3,529,336 A * 9/1970 Winkler et al. ..... 101/351.7
3,554,070 A * 1/1971 Boyd ..... 101/226
3,578,761 A * 5/1971 Sarka ..... 493/60
3,720,126 A * 3/1973 Kranz ..... 83/344
3,926,118 A * 12/1975 Preuss ..... 101/136
4,187,752 A * 2/1980 Chesnut ..... 492/22
4,596,546 A * 6/1986 Schellenberg ..... 101/226
5,133,235 A * 7/1992 DeVito ..... 101/224
5,174,186 A * 12/1992 Baba et al. ..... 83/347
6,073,530 A * 6/2000 Dombkowski ..... 83/347

FOREIGN PATENT DOCUMENTS

EP 0842774 A2 * 5/1998

* cited by examiner

*Primary Examiner*—Boyer D. Ashley
(74) *Attorney, Agent, or Firm*—McNair Law Firm, P.A.

(57) ABSTRACT

The invention relates to a perforating, grooving or cutting device for a multicolor or single-color sheet-fed rotary press (1) comprising printing and/or varnishing groups (2), at least one of which has a rubber cylinder (3) with a holding system (14) for a blanket, as well as an associated counter-pressure cylinder (4). According to the invention, a rectangular base plate (13) is provided, which is made from a flexible and shape-retaining material over which it is possible to glue embossed treatment profiles (29, 37) used as perforating and/or grooving and/or punching profiles corresponding to perforating and/or grooving and/or punching shapes which can be predetermined. Furthermore, at least two fastening strips (17, 18) are provided for detachably attaching the punch foil to opposed marginal areas in the stretched state.

10 Claims, 4 Drawing Sheets

PERFORATING, GROOVING OR CUTTING DEVICE FOR A MULTICOLOR SHEET-FED ROTARY PRESS

FIELD OF THE INVENTION

The invention relates to a perforating, grooving or punching apparatus for multi-color or single color sheet-fed rotary presses.

BACKGROUND OF THE INVENTION

Multi-color sheet-fed rotary presses comprise several printing and/or varnishing units, each of which is equipped with a rubber cylinder and an appertaining holding system for a blanket. The utilization of such multi-color, offset printing presses for perforating, grooving or punching of sheets is known in the prior art.

U.S. Pat. No. 3,554,070 which issued to Harry S. Boyd on Jan. 12, 1971 discloses a method of gluing perforation strips on a counter-pressure cylinder of a printing and/or varnishing unit and of using this to perforate a sheet supported by the elastic rubber blanket of the rubber cylinder. In this method the perforation strips must be installed on the poorly accessible and non-removable counter-pressure cylinder so that the tasks are difficult and time consuming. Also the correct position of the perforation strips on the built-in counter-pressure cylinder is difficult to find, so that expensive position corrections of the glued perforation strips before the start of priming are frequently necessary. This results in considerable set-up and installation times.

It is also a disadvantage with the Boyd method that the perforation strips are installed on the counter-pressure cylinder for only one print application and must then be removed once more. All the expenses for long setup and installation times and the costs of perforation strips are incurred again with a later print application with the same perforations.

In addition, the perforation strips press themselves into the rubber blanket of the rubber cylinder and cause abrasion with a negative contour so that such a relatively expensive rubber blanket can no longer be used.

A perforation in combination with a running printing is only possible in a non-printed area, since otherwise arching of the sheet and adhesion to the rubber blanket near the perforation strip occur so that the printing image is damaged. For a perforation in a printed sheet area, drying and an expensive additional passage through the machine is therefore necessary.

Furthermore, every sheet arches disadvantageously near the perforation because of impressions into the yielding rubber blanket so that the sheet output and stacking can be impeded considerably.

Printing presses with counter-pressure cylinders twice the size of rubber cylinders are also known. In these printing presses a double perforation form can be installed at still considerably higher cost, which is no longer economically sound.

Grooving forms cannot be produced by the above-described methods with satisfactory results, especially since printed sheets in particular become badly frayed in the area of the groove because of the yielding support in the rubber blanket.

Furthermore, DE-OS 23 41 326 discloses a method of gluing perforation strips on the rubber blanket of the rubber cylinder to perforate a sheet with this in the direction of the counter-pressure cylinder, whereby the counter-pressure cylinder is covered by a special, removable stretched foil/sheeting. To mount such a special foil/sheeting, foil holding devices are required on the counter-pressure cylinder so that said counter pressure cylinder can be converted from the normal printing process without a sheet to a perforation process with a sheet. The method described here can therefore only be used with presses with suitably equipped counter-pressure cylinders.

It is also a disadvantage here that the perforation form is removed after a print application from a relatively expensive rubber blanket that can normally be re-used and must again be installed for a later possible print application with the same perforation form. Since the perforation strips press into the relatively soft rubber blanket in this case during the perforation process, a print application and a perforation can be carried out with this arrangement in one machine passage only if the perforation can take place in a non-imprinted sheet area.

According to the description, the perforation strips are to be glued on the rubber blanket outside of the machine, i.e. when the blanket has been removed. Installation with the required dimensional precision is hardly possible in practice, since the position of the rubber blanket with the perforation form applied outside of the press can no longer be corrected after assembly in the press, and dimensional deviation of the outer contour of the raised perforation strips with a rubber blanket mounted cylindrically into the machine from the position of the outer contour when the rubber blanket lies fiat occurs. Thus, when attaching perforation strips on a rubber blanket outside the press, at least a rough dimensional precision must be achieved for the perforations, or the position of the perforation strips must be corrected at high cost in the press as in the previously mentioned method, so that no simplification or improvement can be achieved here in this respect.

This process is described especially in combination with a five-cylinder construction of the printing groups, whereby two rubber cylinders interact with a counter-pressure cylinder and wherein particular perforation lines crossing each other are to be attached to a rubber cylinder. This application is restricted to the special five-cylinder. construction.

Treatment profiles in multiple parts are known from the book printing industry in the form of a tint-printing process, and these consist of a first perforation, grooving or punching strip which can be glued on, of a connection layer connected in a detachable manner to same, and a counter-punch strip or counter-grooving strip connected to the former and also being detachable. Such a counter-punch strip or counter-grooving strip is serf-adjusting as it is placed on a counter-pressure plate during the first passage, and for this an adhesive surface with a pull-off protective foil is provided. For the further treatment of the sheets, the connection layer is pulled off and removed. Such perforation, grooving or punching processes are carried out at relatively slow speed in the book printing industry in separate machine passages. The known multi-part treatment profiles used for this have a large cross-section and it has been practically impossible to use them until now in combination with multi-color sheet-fed rotary, presses, in particular because of the yielding support yielding counter stops or the yielding counter-pressure application.

It is an object of the present invention to provide a perforation, grooving or punching device for multicolor sheet-fed rotary presses that will reduce the cost for such sheet treatment. This object is attained by the invention as set forth in claim 1.

SUMMARY OF THE INVENTION

According to claim 1 the apparatus of the invention comprises a rectangular base plate made of a flexible and shape-retaining material on which can be stretched in place on a rubber cylinder instead of a rubber blanket by means of the blanket holding system. In addition a rectangular base foil/sheeting is provided which is made of a flexible and shape-retaining material, over which it is possible to stick embossed treatment profiles as perforation, and/or grooving and/or punching profiles corresponding to given perforation and/or grooving and/or punching forms. At least two attachment strips are provided on the base plate at a distance from each other (in the built-in state in the circumferential direction of an appertaining rubber cylinder), preferably in opposed marginal areas of the base plate, and the foil/sheeting can be detachably attached to opposed marginal areas by means of same in a stretched condition.

A great number of improvements and advantages are achieved with such a device:

The base plate can be installed very rapidly and easily instead of a rubber blanket on a rubber cylinder, since the blanket holding system provided on the rubber cylinder on the machine side is designed for rapid and easy replacement. According to claim 2, a base plate is equipped for this purpose advantageously with holding rails on opposed marginal areas, said holding rails corresponding lo those of the rubber blankets for the rotary press model used. To that extent the utilization of the device is possible universally with all current press models in printing and/or varnishing plants. Perforation and/or grooving and/or punching forms can be installed easily and comfortably outside the machine on the punch foil. Thanks to the separable attachment of the punch foil on the base plate which is then fixedly installed on the rubber cylinder, and can combine with the separable attachment, relative position corrections between the base plate and the foil/sheeting and thus position corrections relative to a sheet to be treated, can be carried out easily and rapidly without having to change the forms installed on the punch foil. The person schooled in the art has known means at his disposal for rapidly separable attachment of the punch foil on the base plate. With this method only a very short set-up time is required, e.g. for the conversion of a printing or varnishing group to carry out a perforation, grooving or punching operation.

The base plate should be sufficiently flexible so that it can be stretched cylindrically on the rubber cylinder, but should on the other hand be shape-retaining, especially at its surface, and for this reason a plastic plate is especially well suited according to claim 3. The punch foil lies on such a surface-stable base plate, whereby the surface of the base plate is not impressed or arched during a treatment process and an imprinting on the raised treatment profile, contrary to what happens with a rubber blanket. In this way the treatment goes from a support of the process profile on the relatively hard base plate surface to the counter pressure cylinder which is as a rule also provided with a hard surface. Thus the perforation and punching profiles cut through the presented sheet precisely and without arching of the sheet, so that clean punch and perforation cutting edges of high quality result. To achieve this, merely a simple and precise gap adjustment between the foil/sheeting and the surface of the counter-pressure cylinder is required, with a gap width equal to the profile height of the process profiles. This adjustment can be effected by means of the adjusting device already provided on the machine side. Similarly, clean groove forms can also be adjusted and maintained.

Since treatment takes place between relatively hard supporting surfaces and as a result practically no arching of the sheet takes place, the treated sheets remain plane and smooth as before and can be stacked cleanly and high by means of an automated sheet output. This makes also additional trouble free treatments possible, such as e.g. an additional passage through the press.

In a sheet treatment the foil/sheeting does not come into contact with a sheet surface in the vicinity of a process profile when the gap is adjusted correspondingly. As a result, and because of the precise, cutting-like treatment, perforations and punch-outs, for example can be carried out in one work operation with printing when the printing color has not yet dried, even when the perforations and punches are located in the imprinted area. Thus drying times in additional passages of the sheets through the press can be avoided, so that possibly considerable cost savings can be obtained.

It is a considerable advantage of this device that the foils/sheeting with installed perforation, grooving or punching forms can be archived for later identical print applications. The cost of such archiving is relatively low because economic punch foils/sheeting, e.g. thin, preferably 0.18 mm thick plastic foils can be used according to claim 4. Thus, archiving is possible in particular in a space-saving hanging file.

For subsequent print applications with the same perforation, grooving or punching forms, these no longer have to be built up at great cost. Merely a quick conversion and attachment of the punch foils already available for this is necessary, so that considerable cost savings can be achieved with such subsequent orders. A punch foil with the characteristics of claim 5, treatment profiles can be attached and glued on especially rapidly and precisely. For this purpose the punch foil is provided with a perpendicular grid line arrangement as a registration grid. The grid lines extend preferably in the axial direction of an appertaining rubber cylinder at millimeter distances from each other. Grid lines adjoining each other in the circumferential direction of an assigned rubber cylinder also have equal distances between lines, but these are slightly less than 1 mm. These reduced distances between lines take the fact into account that the outer contour of the raised, glued process profiles extends on a larger cylinder diameter than the outer punch foil surface when the punch foil is stretched cylindrically. These differences do not yel appear when the punch foil lies fiat, when the process foils are glued on. Furthermore, with the above-described reduction of spaces between lines, machine-specific and sheet-specific conditions can also be taken into account in addition to the cylinder diameter differences and projections on a plane grid line arrangement which can be calculated.

For an accurate-to-size attachment of process profiles the procedure consists in measuring out the process form on a printing plate model or a sheet model. The numerical values found by measurement are then transferred into the grid-line arrangement, whereby only the corresponding numerical values and not the measured values are transferred. The corresponding glued process profiles then produce the accurate-to-size process form in the development on the sheet when the punch foil is stretched cylindrically.

The characteristics of claim 6 can be used for rapid and simple attachment of the punch foil on the base plate, whereby the possibility is given to correct the position of the punch foil relative m the base plate. It is proposed for this purpose to attach the fastening strips so as to be capable of displacement relative to the base plate and capable of being fixed, and to connect the punch foil fixedly and separably to the fastening strip. For this connection, alignment pins and assigned punch-outs of the punch foil are used. For a plurality of punch foils in one archive, punch-outs with the same layout must be provided.

According to claim 7, holding strips can also be installed in the marginal areas of the punch foil, and these can then be connected to the fastening strips. Here, too, adjustment zones can be provided between a fastening strip and a holding strip, and in that case the fastening strips could possibly be attached fixedly to the base plate.

A number of arrangements are generally known for such attachments capable of being shifted and fixed. According to claim 8, simple and inexpensive screw and slot connections are used. Depending on conditions, fastening strips in two parts, with one strip part fastened to the base plate and a second strip part movable relative to the first strip can be used and/or holding strips between which the base plate or possibly also the punch foil can be held.

With punch or perforation profiles on the punch foil and with non-chromed counter-pressure cylinders it is advantageous to precisely position opposing counter-punch metal sheets there. This also applies to grooving profiles, whereby in this case counter-grooves must be positioned precisely. For this claim 9 proposes the utilization of multi-part process profiles. These consist of a first perforating, grooving or punching strip glued on the punch foil and a connection layer strip, preferably a plastic profile strip, separably connected to same. A counter-punch sheet metal strip or a counter-groove strip with one adhesive face away from the punch foil covered with a pull-off protection film is in turn separably connected to it. For installation, the entire multi-part process profile is first glued in precise position on the punch foil and the latter is mounted into the printing press together with the base plate. Following this, the protective film is removed from the adhesive surface by the counter-punch strip or by a counter-groove strip and the press is typed through once with adjusted pressure, so that the counter-punch sheet metal strips or counter-groove strips automatically adhere to the counter-pressure cylinder and assume their precise position. The connection layer strip is then pulled off and removed. In this manner the position of the counter-punch sheet-metal strip or of the counter-groove strip is fixed precisely and centered relative to the perforation or punching or grooving profile. By means of counter-punch strips of different heights it is also possible to produce a combined grooving, punching and perforation form. Precise positioning of the counter-grooves makes it possible to obtain grooving of book-printing quality. According to claim 10 these process profiles are to be designed for universal utilization in the offset process with little width, preferably within a range of 2 mm. The range of 0.7 mm has been shown to be a suitable height of the perforation, grooving or punching strips, but depending on special conditions other heights can also be suitable. Examples of embodiments of the invention are explained in further detail through the drawings.

DESCRIPTION OF THE DRAWINGS

The drawings attached hereto and made a part of this specification are presented by way of illustration and are not limiting on the scope of the invention. In the drawings.

DETAILED DESCRIPTION

Figure 1:
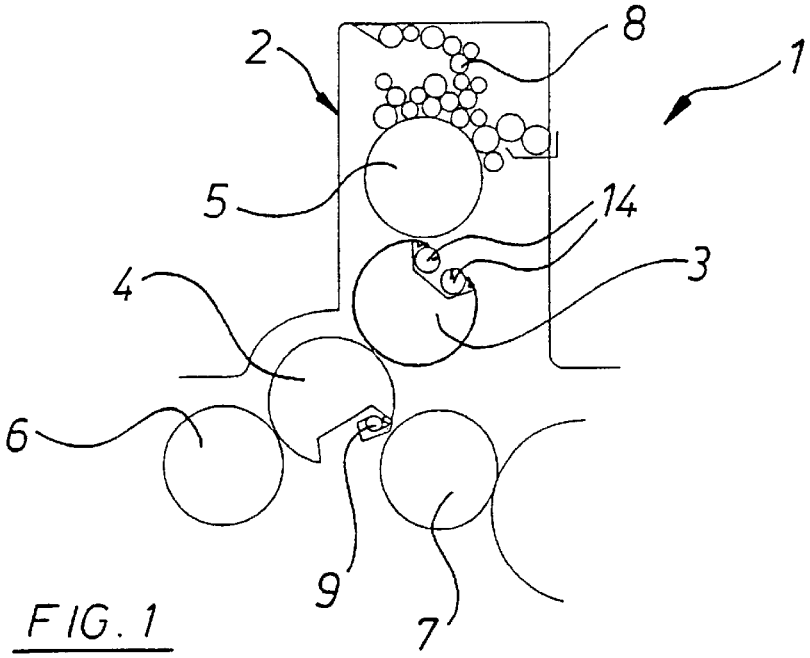
FIG. 1 shows a schematic view of the printing group of a multi-color rotary press.

Referring now to the drawings, the invention will now be described in more detail.

In FIG. 1, a conventional printing and varnishing unit 2 of a multi-color sheet-fed rotary press 1 comprising several printing and varnishing units 2 is shown schematically. This printing group 2 has a plate cylinder 5 by means of which color 8 is applied on a rubber blanket of a rubber cylinder 3 according to a color passage of a printing format. The printing format is applied via this rubber cylinder 3 on a printed sheet stretched over a counter-pressure cylinder 4. This printed sheet is conveyed in the printing and varnishing unit 2 via a sheet conveying cylinder 6 into proximity of the counter-pressure cylinder 4 and is grasped by a paper grasper 9 located on the counter-pressure cylinder counter-pressure cylinder 4. As a result the sheet is entrained into contact connection in the course of further rotation of the counter-pressure cylinder 4 and is imprinted. Following this imprinting of the sheet the paper grasper 9 releases the sheet again so that il can be removed via the sheet conveying cylinder 7.

Figure 2:
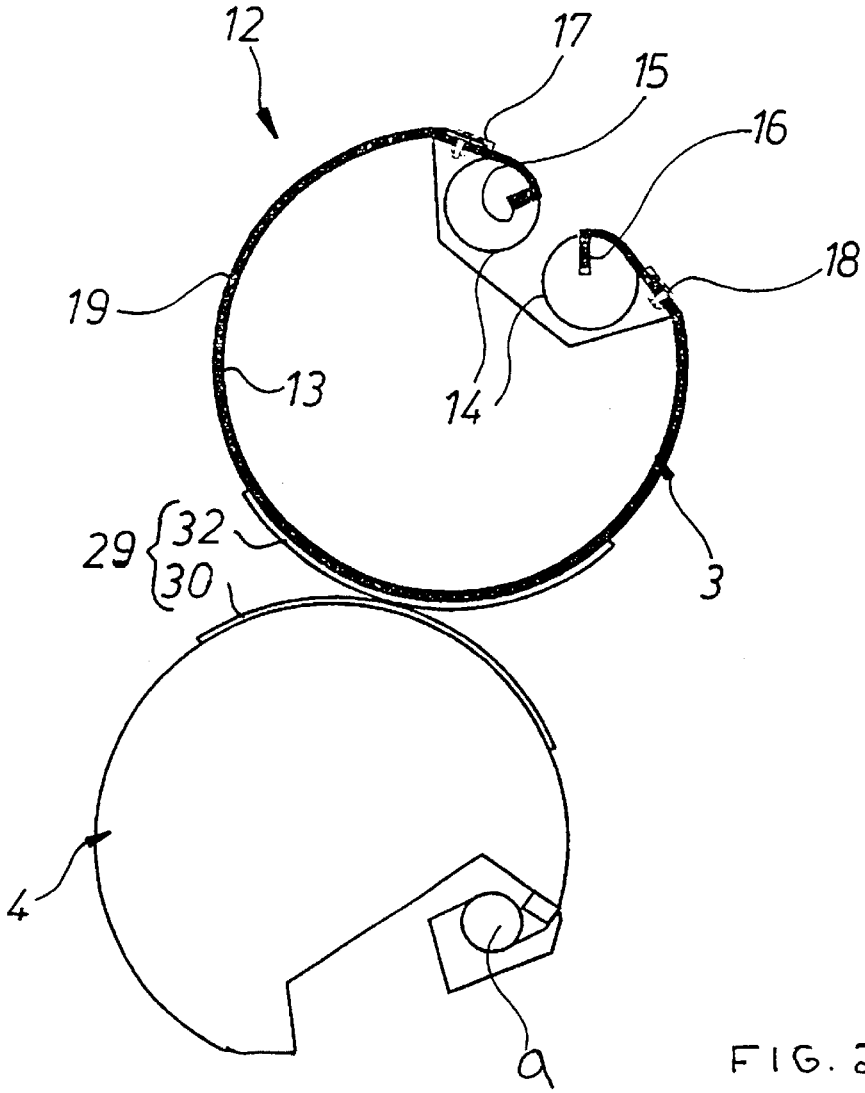
FIG. 2 shows a schematic lateral view of a rubber cylinder with associated counter-pressure cylinder, with a grooving device.
Figure 3:
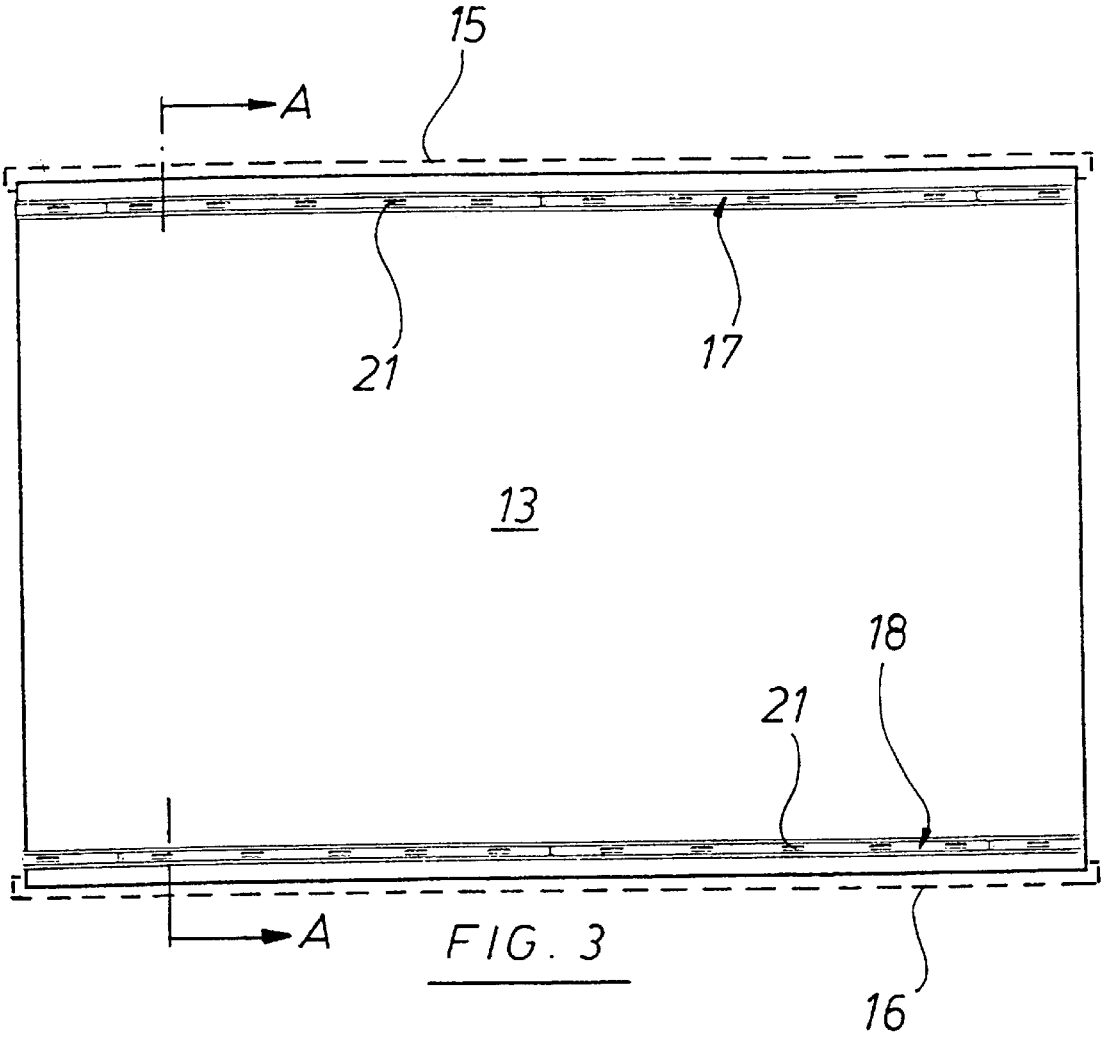
FIG. 3 shows a top view of a rectangular base plate which can be stretched on a rubber cylinder.

As can be seen in FIG. 2, the printing and varnishing unit 2 of the multi-color sheet-fed rotary press 1 can be equipped for perforating, grooving or punching of a sheet in accordance with the invention by using a device 12 for perforating, grooving or punching. For this purpose a rectangular plastic plate 13 is stretched on tho rubber cylinder 3 of the printing and varnishing unit 2 instead of the usual rubber blanket. As can be seen in FIG. 3, this plastic plate 13 is equipped in marginal areas across from each other in the circumferential direction of its assigned rubber cylinder 3 with holding rails 15, 16 which correspond to those of the rubber blankets of the given rotary press model. Thus, the plastic plate 13 can be stretched as rapidly and simply as a rubber blanket on the rubber cylinder 3 by means of the blanket holding system 14 located on the rubber cylinder 3.

Figure 4:
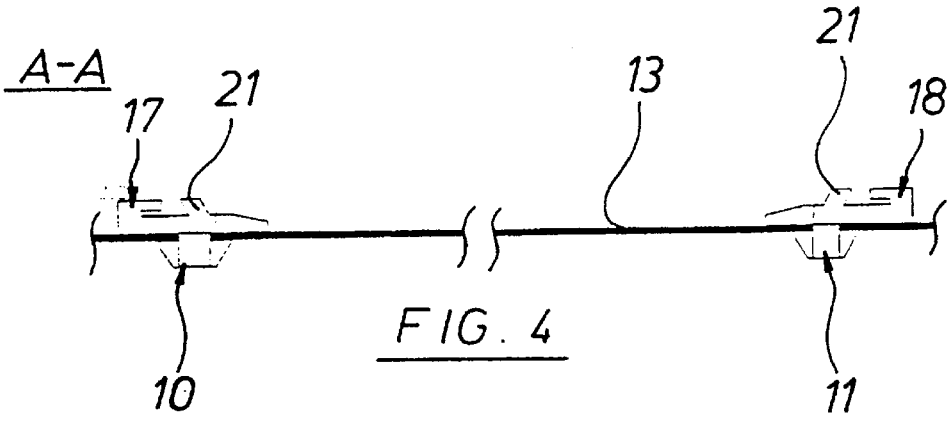
FIG. 4 shows a section through the base plate of FIG. 3 along line A—A.

As can further be seen in FIG. 3, fastening strips 17, 18 for a punch foil 19 are located on the facing marginal areas as seen in the circumferential direction of the rubber cylinder 3. These fastening strips 17, 18 can be screwed to a strip 10, 11 riveted to the underside of the plastic plate 13 as can be seen in particular in FIG. 4.

Figure 5:
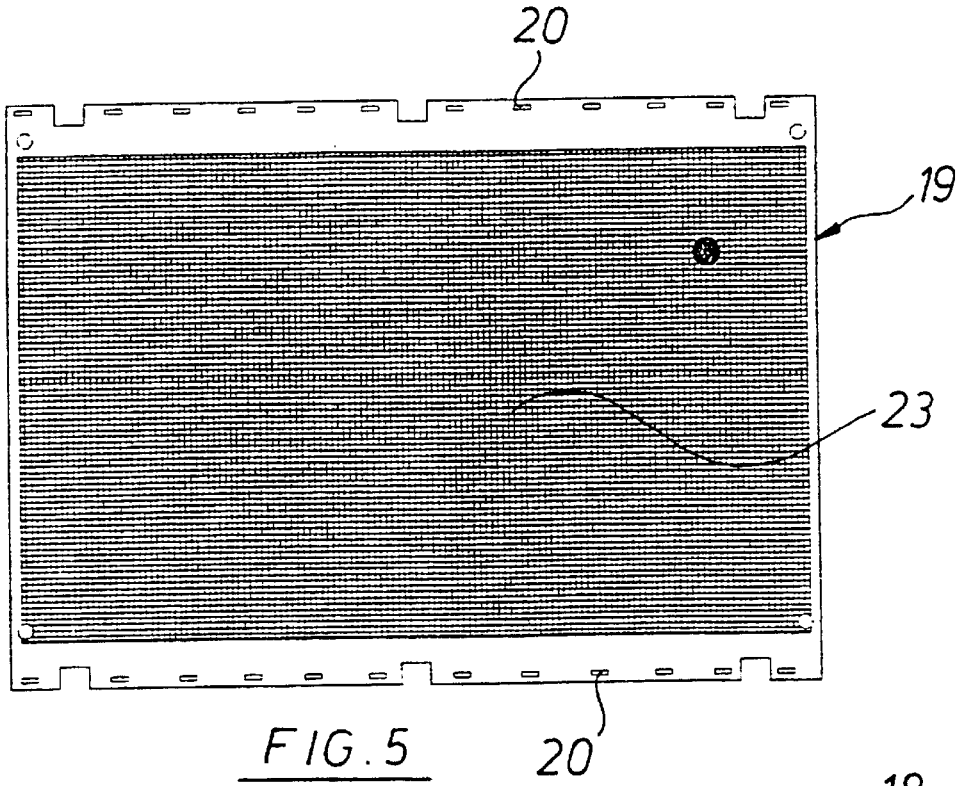
FIG. 5 shows a top view of a rectangular punch foil with a grid line arrangement at a right angle.
Figure 6:
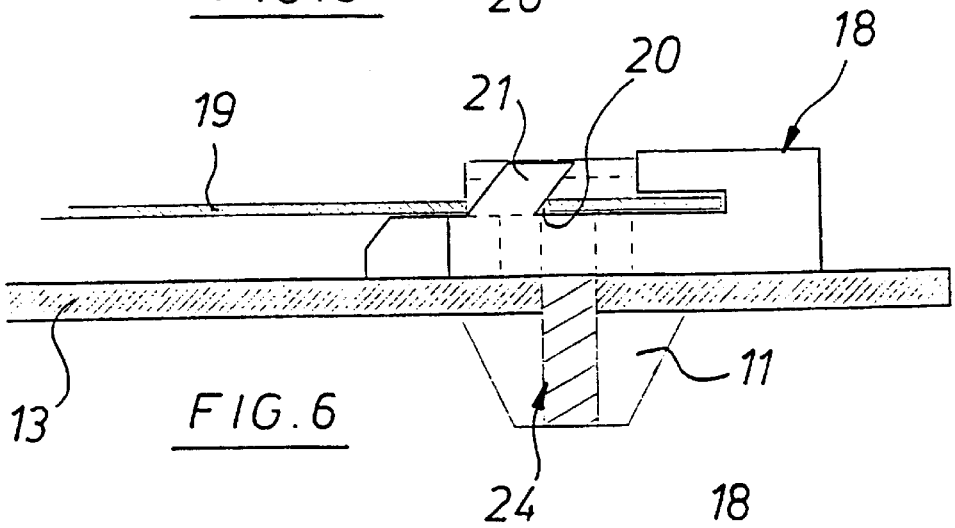
FIG. 6 shows a schematic partial view of a punch foil hooked to a base plate.
Figure 7:
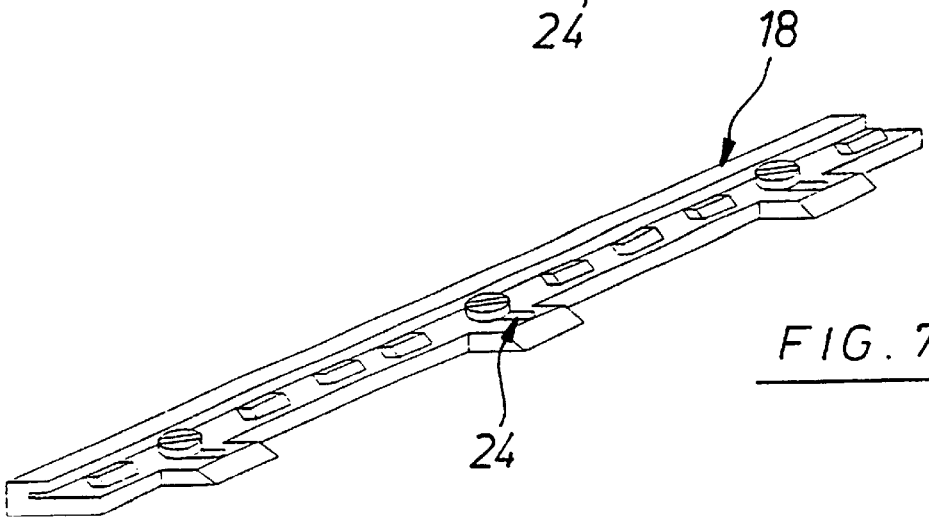
FIG. 7 shows a perspective view of a fastening strip.

The punch foil 19 is provided with punched perforations 20 in opposed areas as seen in circumferential direction of the rubber cylinder 3 as shown in FIG. 5. The punch foil 19 can be hooked by these punched perforations 20 into correspondingly assigned alignment pins on the fastening strips 17, 18 as shown in FIG. 6.

Perforation and/or grooving and/or punching profiles according to predetermined perforation and/or grooving and/or punching forms are glued on the punch foil 19, as is shown for example in FIG. 2 with a raised groove profile strip 32 of a process profile 29, whereby a counter-groove strip 30 on the counter pressure cylinder 4 is associated with this process profile 29.

For rapid and accurate-to-size attachment and gluing of these process profiles, the punch foil 19 is provided with a right-angle grid line arrangement 23. Here the grid lines extend in axial direction of the associated rubber cylinder 3 at distances of one millimeter from each other. Adjoining each other in the circumferential direction of the associated rubber cylinder 3, gridlines also have equal distances between lines, whereby these are however, slightly less than 1 mm. With these reduced distances between lines the fact was taken into consideration that when the punch foil 19 is stretched cylindrically, the outer contour of the raised, glued process profiles comes out to a greater cylinder diameter than the outer punch foil surface.

In order to make a correction of position possible after gluing the process profiles on the punch foil 19 and the attachment of the punch foil 19 on the plastic plate 13, the fastening strips 17,18 are designed with screw and slot connections 24 so that they can be displaced relative to plastic plate 13 in the circumferential direction of the associated rubber cylinder 3. In addition, the punch foil 19 can be with provided with holding strips in the circumferential direction of the associated rubber cylinder 3 which are attached by means of screw and slot connections to the fastening strips 17,18 in such manner that an adjustment of the punch foil 19 in axial direction of the associated rubber cylinder 3 is also possible, but this is not shown here. In this way a positional correction is possible in the circumferential direction as well as in axial direction of the associated rubber cylinder 3.

For an accurate-to-size attachment of process profiles the desired process forms are first measured on a printing plate model or a sheet model. The numerical values thus found are then transferred to the grid line arrangement of the flat 19, whereby no transfer of the metrical measured values but only of the corresponding numerical values takes place. The correspondingly glued process profiles then provide the accurate-to-size process form in the developed view on the sheet as taken from the model when the punch foil is cylindrically stretched.

On the one hand the plastic plate 13 is flexible so that it can be stretched cylindrically on the rubber cylinder 3. On the other hand it is so stable at its surface that in a treatment process and when pressure is applied on the raised process profiles, the surface of the plastic plate 13 at that location is not crushed and does not arch, as is the case with a rubber blanket. As a result the treatment of a support of the process profiles on the relatively hard plastic plate surface is done here on the relatively hard plastic plate surface of the counter-pressure cylinder 4, which is also provided with a hard surface. Thereby, the perforation and punching profiles cut precisely through the sheet without any arching of the latter so that clean punch-out and perforation edges of high quality result. For this it is merely necessary to adjust the gap between the punch foil 19 and the surface of the counter pressure cylinder 4 very precisely, whereby the gap between the punch foil 19 and the surface equal to the profile heights of the process profiles. When stretching and installing the plastic plate 13 together with the punch foil 19 and the process profiles, care must be taken that the overall height is precisely equal to maculation ring level.

This treatment of the sheets between hard supporting surfaces prevents practically all arching of the sheets, so that the processed sheets can be stacked plane and flat as before. This also makes additional trouble-free treatment possible, e.g. in additional machine passes.

The detachable attachment of the punch foil 19 on the plastic plate 13 makes it possible to remove the latter after every print application easily and simply from the base plate 13 and to be archived for possible later, identical print applications.

Figure 8:
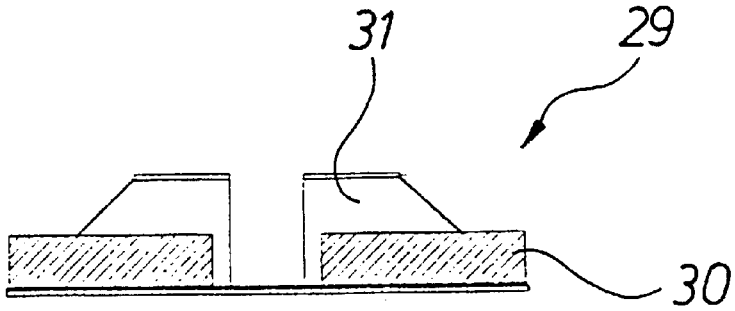
FIG. 8 shows a schematic sectional view of part of a first embodiment of a process profile with a counter-groove strip and an associated connection layer strip.

With process profiles placed on the punch foil 19 and non-chromed counter-pressure cylinders 4 it is advantageous to affix precisely opposite counter-profiles there. For this purpose the process profile 29 is made in several parts in a first embodiment according to FIGS. 8, 9. This process profile 29 comprises a first counter-groove strip 30 which can be glued to the counter-pressure cylinder 4 and a connection layer strip 31 detachably connected to it as a plastic profile strip as shown in FIG. 8.

Figure 9:
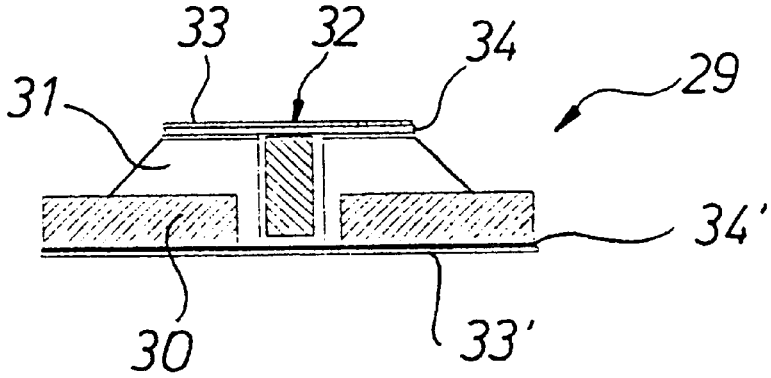
FIG. 9 shows a schematic sectional view of the complete process profile of FIG. 8 with a groove profile strip, connection layer strips and counter-groove strip.

A groove profile strip 32 is detachably connected to the connection layer strip 31 of this first part of the process profile 29 as shown in FIG. 9. This groove profile strip 32 is provided with an adhesive surface 34 directed upon the punch foil 19 and covered with a pull-off protective film 33.

To be installed, the process profile 29 is glued via the groove profile strip 32 in exact position on the punch foil 19 and the latter is mounted in the rotary press 1 with the plastic plate 13 The protective film 33 is then removed from the adhesive surface 34 on the counter-groove strip 30 and the rotary press 1 is typed through once with the pressure adjusted causing the counter-groove strip 30 to adhere automatically and in precise position to the counter-pressure cylinder 4. The connection layer strip 31 is then pulled off and removed. Thereby the position of the counter-groove strip 30 is exactly centered relative to the groove profile strip 32.

Figure 10:
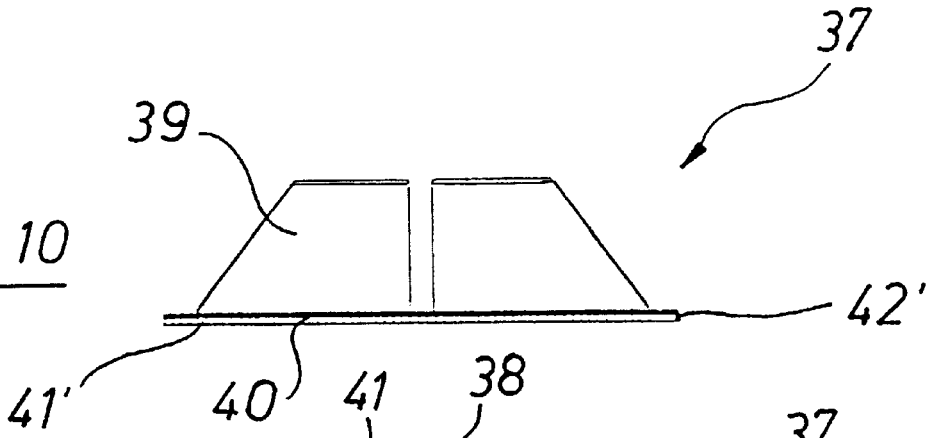
FIG. 10 shows a schematic sectional view of part of a second embodiments of a process form with counterpunch sheet metal strips and assigned connection layer strip.
Figure 11:
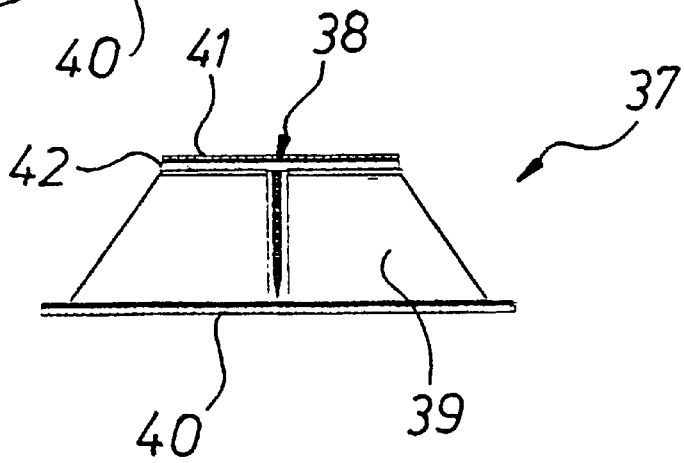
FIG. 11 shows a schematic sectional view of the complete process profile of FIG. 10 with counter-punch sheet metal strips, connection layer strips and punch profile strips.

FIGS. 10 and 11 show a second, alternative embodiment of a process profile 37. This process profile 37 consists of a counter-punch sheet metal strip 40 as shown in FIG. 10 which is detachably connected to a connection layer strip 39. As can be seen in FIG. 11, the process profile 37 furthermore comprises a punch profile strip 38 which is provided with an adhesive surface 42 covered by a pull-off protective film 41 and which is detachably connected to the connection layer strip 39.

Here, too, in order to install the process profile 37 it is first glued in exact position together with the punch profile strip 38 on the punch foil 19, and the latter is then mounted with the plastic plate 13 in the rotary press 1. The rotary press 1 is then typed through once as for the embodiment of FIGS. 8, 9, so that the counter-punch sheet metal strip 40 automatically adheres to the counter-pressure cylinder 4 via the adhesive surface 42' and assumes an exact position. The connection layer strip 39 is then pulled off and removed.

Depending on whether the clamping action between the profile strips 32, 38 and connection layer strips 31, 39 is weaker or stronger than the clamping force between the counter-strips 30, 40 and the connection layer strips 31, 39, the connection layer strip 31, 39 adheres to either the profile strips 32 or 38 or to the counter strips 30 or 40 when the rotary press has been typed through.

The process profiles 29, 37 are preferably 2 mm wide while the groove profile strip 32 or the punch profile strip 38 is preferably approximately 0.7 mm high.

While a preferred embodiment of the invention has been described using specific terms, such description is for illustrative purposes only, and it is to be understood that changes and variations may be made without departing from the spirit or scope of the following claims.

What is claimed is:

1. In a single or multicolor sheet-fed rotary press with printing or varnishing groups, an apparatus for perforating, grooving, or punching which comprises:

a) a counter pressure cylinder (4), b) a rubber cylinder (3) with a blanket holding device (14);

c) rectangular base plate (13) made of a flexible and form-retaining material which is attached detachably on the rubber cylinder (3) by means of the blanket holding device (14);

d) a rectangular punch foil (19) made of a flexible and form-retaining material;

e) raised process profiles (32;38) attached to the foil (19) as perforating, grooving, or punching profiles, said raised process profiles being positioned according to a predetermined model for perforating, grooving, or punching, and;

f) at least two fastening strips (17, 18) installed spaced apart from each other in the circumferential direction of the rubber cylinder (3) by means of which the punch foil (19) is attached in a stretched state around the rubber cylinder and in a detachable manner to opposing marginal areas.

2. An apparatus according to claim 1 wherein said base plate (13) is provided with holding rails (15, 16) in marginal areas opposite to each other extending in the circumferential direction of the rubber cylinder (3) arranged with a rubber blanket selected from commercially obtainable rubber blankets usable in said rotary press.

3. An apparatus according to claim 1 wherein the base plate (13) is made from a plastic plate with a stable surface.

4. An apparatus according to claim 1, wherein the punch foil (19) comprises a thin plastic foil, about 0.18 mm thick.

5. An apparatus according to claim 1 wherein a right-angle grid line arrangement (23) used as a measuring grid is provided on punch foil (19), whereby the grid lines adjoining each other in the axial direction of rubber cylinder (3) have first identical distances between lines in a metric measure, of distances of about one millimeter, and the grid lines adjoining each other in the circumferential direction of the rubber cylinder (3) are at spaced apart distances from each other, the second distances between lines being shorter than the first distances between lines, and take into account that the rubber cylinder diameter of an outer contour of the raised, process profiles (32; 38) is greater than a smaller cylinder diameter of the cylindrically stretched punch foil surface when the process profiles (32; 38) are attached with a flat lying punch foil (19).

6. An apparatus according to claim 1 wherein the fastening strips (17, 18) are capable of being displaced and fixed relative to the base plate (13) within a predetermined adjustment range, in the circumferential direction of rubber cylinder (3), and punch foil (19) are connected detachably and fixedly to the fastening strips (17, 18), by means of accurate-to-size alignment pins and associated punch-outs (20) of the punch foil (19).

7. An apparatus according to claim 6 wherein the fastening strips are attached to the marginal areas of the punch foil (19), by means of which the punch foil (10) can be shifted and fixed within predetermined adjustment ranges with fastening strips (17, 18).

8. An apparatus according to claim 7 including screw and slot connections (24) with the fastening strips (17, 18) between which the base plate (13) or the punch foil (19) is adjustably clamped and fixedly held.

9. An apparatus according to claim 8 including the process profiles (29, 37) being made in multiple parts and comprising a first perforating, grooving, or punching profile (32,38) which is glued to the punch foil (19), a connection layer strip (31,39), an adapted plastic profile strip, and a counter-punch sheet metal strip (40) or a counter-groove strip (30) connected detachably to the connection layer strip (31, 39) provided with an adhesive surface (34,42) which is covered with a pull-off protective film (33, 41) facing away from the punch foil.

10. An apparatus according to claim 9 wherein the process profiles (29, 37) have a narrow width of about 2 mm and wherein the height of the perforating, grooving or punching profile strips (32,38) is about 0.7 mm.

* * * * *